US006626405B1

(12) United States Patent
Keast et al.

(10) Patent No.: US 6,626,405 B1
(45) Date of Patent: Sep. 30, 2003

(54) REPLACEABLE FLOOR PROTECTORS

(76) Inventors: James Keast, 26073 Baldwin Pl., Stevenson Ranch, CA (US) 91381; Martin Downen, 24131 Clear Bank La., Newhall, CA (US) 91321

( * ) Notice: Subject to any disclaimer, the term of this patent is extended or adjusted under 35 U.S.C. 154(b) by 0 days.

(21) Appl. No.: 10/163,980

(22) Filed: Jun. 5, 2002

(51) Int. Cl.[7] ..... A47B 91/00

(52) U.S. Cl. ..... 248/188.9; 248/346.11; 16/42 R

(58) Field of Search ..... 248/188.4, 188.9, 248/346.11; 16/42 R, 42 T

(56) References Cited

U.S. PATENT DOCUMENTS

| | | | | | |
|---|---|---|---|---|---|
| 14,964 | A | * | 5/1856 | Anderson | 473/49 |
| 156,927 | A | * | 11/1874 | Jewell | 248/188.4 |
| 771,679 | A | * | 10/1904 | Stock | 248/188.9 |
| 1,165,046 | A | * | 12/1915 | Von Der Lin | 248/188.4 |
| 1,208,546 | A | * | 12/1916 | Hachmann | 248/188.9 |
| 1,367,922 | A | * | 2/1921 | Ramsey | 16/42 R |
| 1,400,781 | A | * | 12/1921 | Wagner, Jr. | 16/42 R |
| 1,518,771 | A | * | 12/1924 | Campbell | 16/42 R |
| 1,638,725 | A | * | 8/1927 | Chesnutt | 16/42 R |
| 1,720,806 | A | | 7/1929 | Vollmer | |
| 1,824,923 | A | * | 9/1931 | Parsons | 248/188.9 |
| 1,855,625 | A | * | 4/1932 | Darnell | 16/42 R |
| 1,861,094 | A | * | 5/1932 | Schacht | 16/42 R |
| 1,875,588 | A | * | 9/1932 | Golden et al. | 248/188.4 |
| 1,981,728 | A | * | 11/1934 | Harris | 16/42 R |
| 2,458,621 | A | | 1/1949 | Miller | |
| 2,476,366 | A | * | 7/1949 | Grimm | 248/188.4 |
| 2,476,381 | A | * | 7/1949 | Peavey | 248/188.4 |
| 2,499,277 | A | | 2/1950 | Nalle | |
| 3,027,680 | A | * | 4/1962 | Gallagher, Jr. | 248/188.4 |
| 3,078,498 | A | * | 2/1963 | Morgan | 16/42 R |
| 3,183,545 | A | * | 5/1965 | Bergstrom | 16/42 R |
| 3,191,213 | A | * | 6/1965 | Congdon | 16/42 R |
| 3,326,508 | A | | 6/1967 | Born | |
| 5,191,676 | A | | 3/1993 | Gerner | |
| 5,680,673 | A | | 10/1997 | Beshore | |
| 5,988,574 | A | * | 11/1999 | Podgorski et al. | 248/188.4 |
| 6,155,530 | A | * | 12/2000 | Borgen | 248/638 |
| 6,324,725 | B1 | | 12/2001 | Green | |

* cited by examiner

*Primary Examiner*—Korie Chan
(74) *Attorney, Agent, or Firm*—Louis J. Bovasso; Greenberg Traurig LLP

(57) ABSTRACT

A floor protector for the legs of a chair or table including an insert receivable in the bottom of the leg which includes a removable floor protector retaining member. A floor protector of a pad of a soft floor protective material is removably mounted in the retaining member having a portion extending downwardly from the retaining member in contact with the floor or the like on which the chair or table is disposed. The pad can be quickly and easily replaced when worn.

8 Claims, 2 Drawing Sheets

REPLACEABLE FLOOR PROTECTORS

BACKGROUND OF THE INVENTION

1. Field of the Invention

The invention relates to floor protectors; and, more particularly, to replaceable floor protectors for the legs of chairs and tables to protect floors from damage.

2. General Background and State of the Art

It is well known to provide a glide at a bottommost portion of a furniture table leg to facilitate the sliding movement of the furniture across a floor. Glides are known to take a variety of forms, but may typically include an upper portion adapted to be attached to the leg of a piece of furniture such as a chair or table; and a lower portion having a smooth, low friction bottom surface for contacting the floor. U.S. Pat. No. 5,010,621 issued to Bock on Apr. 30, 1991, and U.S. Pat. No. 5,170,972 issued to Guell on Dec. 15, 1992, disclose typical furniture glides as are known in the art.

Some tables and chairs may also have some sort of cap or the like which fits onto the table or chair leg and can be replaced when worn. These glides and caps may mark up wood floors or the like as the chair or table is moved across the wood floor.

There is a need for a flooring protector which can be fitted to the leg of a chair or table and can be renewed or replaced when worn. Such protector may be a felt pad or the like and quickly and easily replaceable.

INVENTION SUMMARY

It is an object of this invention to provide a replaceable floor protector for the leg of a chair or table to protect floors.

It is still another object of this invention to provide such a protector in the form of a removable pad so it can be replaced when worn.

These and other objects are preferably accomplished by providing a floor protector which fits onto the legs of a chair or table and includes an insert receivable in the bottom of the leg. The insert includes a removable floor protector retaining member. A floor protector of a pad of a soft floor protective material is removably mounted in the retaining member having a portion extending downwardly from the retaining member in contact with the floor or the like on which the chair or table is disposed. The pad can be quickly and easily replaced when worn.

DETAILED DESCRIPTION OF THE PREFERRED EMBODIMENTS

Figure 1:
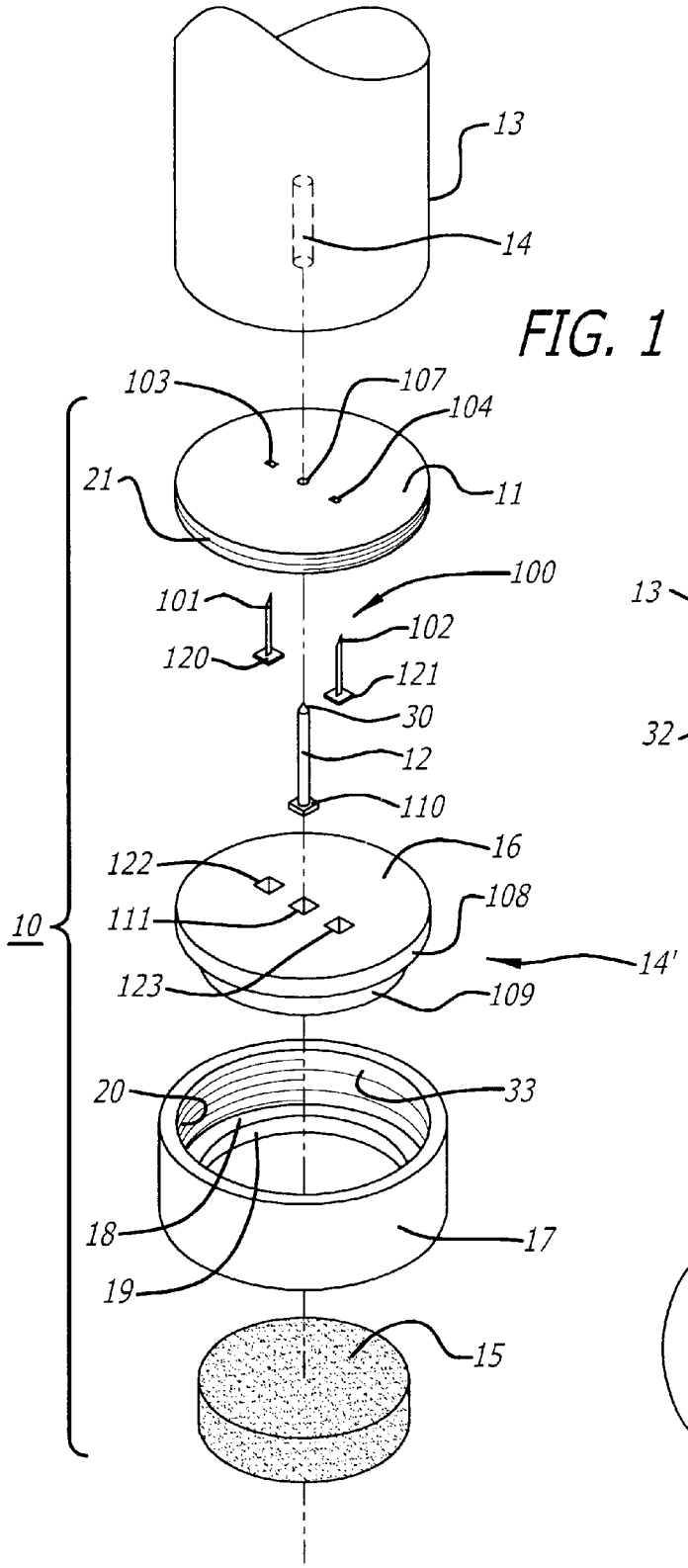
FIG. 1 is an exploded view of the device of the invention as applied to a chair leg.

Referring now to FIG. 1 of the drawing, a portion 13 of a conventional chair or table leg is shown. This leg 13 may have a hole 14 therein due to a prior floor protector having been inserted therein. Hole 14 may also be threaded having previously received the threaded shaft of a floor protector. Also, leg 13 may not have any hole therein as will be discussed.

Figure 2:
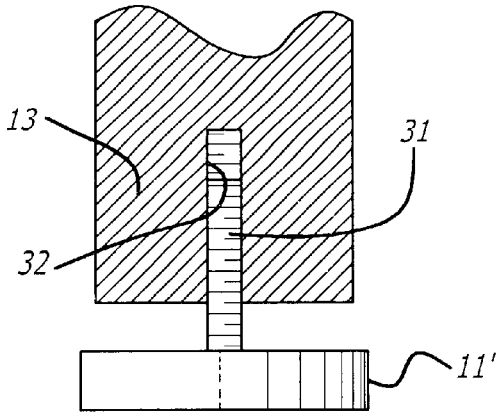
FIG. 2 is an alternative way of securing the device of the invention to a chair leg.

A floor protector assembly 10 in accordance with the teachings of the invention is shown in exploded view in FIG. 1. Assembly 10 includes a main body portion 11 having a clip 100 with a pair of spaced prongs 101, 102, each having a head 120, 121, respectively terminating in sharpened points receivable in spaced holes 103, 104 respectively of body portion 11. Nail 12 has a pointed end 30 and a head 110 which can either be driven into the bottom of leg 13 forming hole 14, or inserted into hole 14 if hole 14 already exists. The pointed end 30 of nail 12 is receivable in the hole 107 in the main body. Alternatively, as seen in FIG. 2, wherein like numerals refer to like parts of the embodiment of FIG. 1, instead of nail 12, a screw 31 extending from main body portion 11' (similar to portions 11) may be screwed into threaded hole 32 in leg 13.

Figure 3:
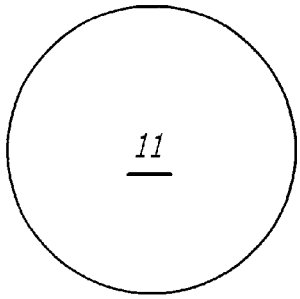
FIG. 3 is a view taken along line 3—3 of FIG. 1.

Referring again to FIG. 1, main body portion 11 may be cylindrical (see FIG. 3) and threaded on its outer periphery 21. A floor protector 14' is provided having an upper flange portion 16 and an integral downwardly extending floor protector portion 15. Portion 15 may be comprised of a soft but relatively rigid material, such as felt, so as to resist wearing but provide a protection for the floor on which the chair or table rests. As also seen in FIG. 1, flange 16 may be circular in cross-section having a main body section 108 greater in outer diameter than the diameter of portion 15 and an integral lower section 109 similar in outer diameter to that of portion 15 for reasons to be discussed.

A retainer 17 is provided, also circular in cross-section, having an upstanding vertical peripheral wall 20. Wall 20 is threaded on its interior at threaded portion 33 and is integral with a lower horizontal wall 18. Wall 18 extends inwardly from wall 20 and has an opening 19 therethrough.

Figure 4:
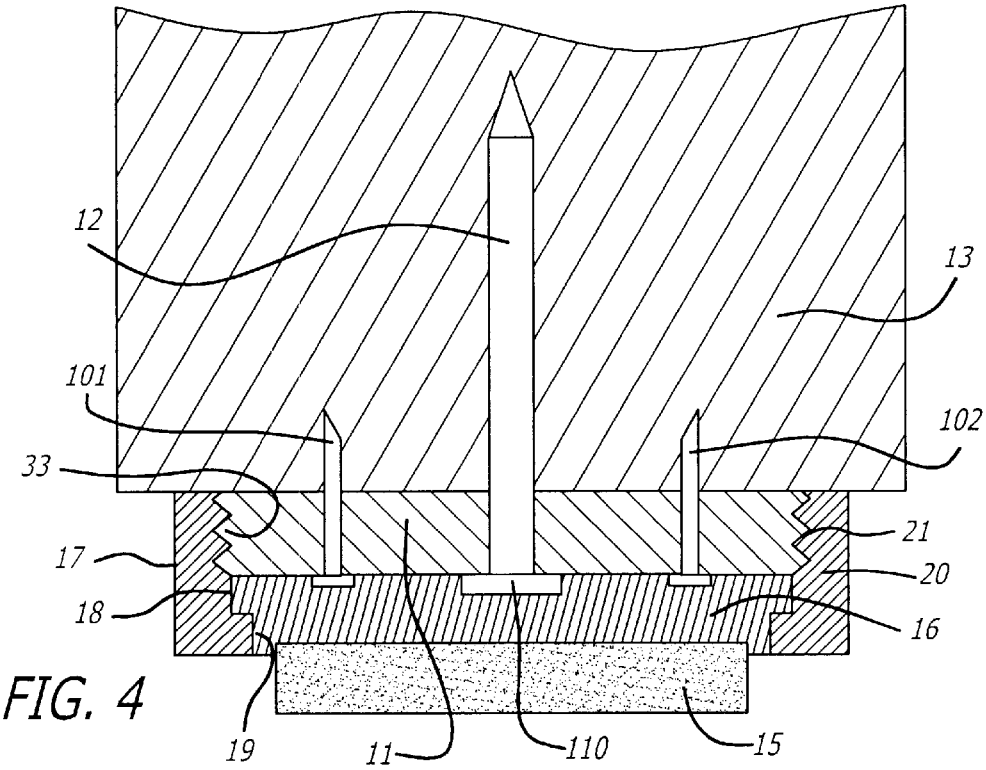
FIG. 4 is assembled view of the parts of FIG. 1.

The assembled parts are shown in FIG. 4. It is to be understood that nail 12 is driven or otherwise inserted into leg 13 with prongs 101, 102 entering the bottom of the leg 13 and preventing the parts from rotating with respect to leg 13. Head 110 is inserted in the like configured slot 111 in flange portion 16 and heads 120, 121 are inserted into spaced slots 122, 123 on each side of slot 111. Floor protector portion 15 is secured to the bottom of flange portion 16 in any suitable manner, as by glueing. It can thus be seen in FIG. 4 that a substantial portion of the floor protector portion 15 protrudes downwardly in opening 19 past wall 18 as seen. Wall 20 is now threaded onto threaded peripheral wall 21 of the main body portion 11.

The protector portion 15 thus protects the floor from damage due to the leg 13 moving thereon. When worn, portions 15 and 16 can be quickly and easily replaced. Alternatively, portion 15 may be removably attached to portion 16 in any suitable manner, such as by screws, so pad 15 need only be replaced.

The invention can be used on any chair or table leg and may be of any suitable configuration to accommodate the same. As seen in FIG. 4, the assembled parts are secured to the leg 13 with no side movement between the assembled parts and leg 13.

Figure 5:
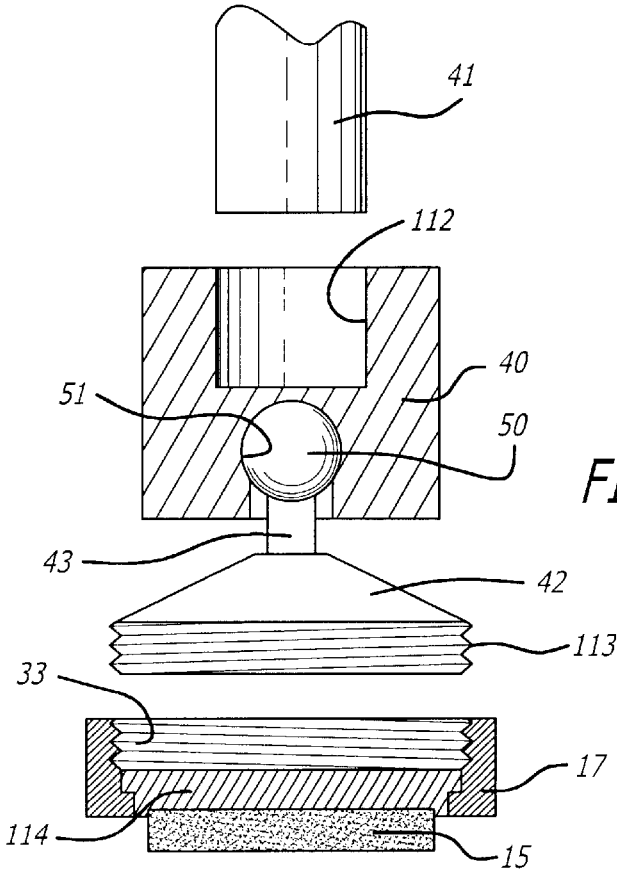
FIG. 5 an exploded view of an alternative embodiment of the invention.

However, glides or the like are well known in the furniture art that swivel to accommodate uneven surfaces or the like. This is shown in FIG. 5 wherein like numerals refer to like parts of FIGS. 1, 3 and 4. In this embodiment, a cup 40 is shown having an opening 112 adapted to receive leg 41 of a chair or the like. A member 42 is provided swivelly connected to cup 40 via swivel connection 43 as is well known in the art. Thus, connection 43 may include a ball 50 fitting into a socket 51. Member 42 is threaded on its outer periphery 113 so as to threadably receive thereon the threaded portion 33 of retainer 17. Flange portion 114 is otherwise identical to flange portion 16 but slots 111, 122, 123 have been eliminated. The assembled parts are similar to the parts shown in FIG. 4 and further description is deemed unnecessary.

It can be seen that there is disclosed a quick and easy device for protecting floors and the like, such as wood floors, marble floors, etc., from scuffing due to chair and table legs moving over the floor.

The device can be attached to anything resting on a floor, such as chairs, tables, sofas, couches, etc. as broadly defined, chair can mean anything one can sit on resting on a floor and table can mean a platform having legs or supports resting on a floor.

Any suitable materials may be used, such as plastics, metals, etc. The cup 40 may be of resilient material, such as rubber, to fit on legs of various cross-sections. Any suitable dimensions may be used. For example, main body portion 11 may be about 1" in diameter and about 1" or so in length, including nail 12.

Protector 14' may have an upper portion 16 of a rigid material, such as plastic, and an integral lower portion 15 of a cushioning material, such as felt or the like.

Although a particular embodiment of the invention has been disclosed, variations thereof may occur to an artisan and the scope of the invention should only be limited by the scope of the appended claims.

While the specification describes particular embodiments of the present invention, those of ordinary skill can devise variations of the present invention without departing from the inventive concept.

We claim:

1. A floor protector assembly adapted to be secured to the leg of a chair or table for protecting the floor on which the chair or table rests from scuffing comprising:

a main body portion having securing means associated therewith for securing the same to the leg of a chair or table;

a removable floor protector retainer attached to said main body portion, said retainer having an upper wall and a bottom wall, an opening through said bottom wall; and a floor protector mounted in said opening and retained therein, said floor protector having a portion extending downwardly from and outwardly from the retainer beyond the bottom wall thereof for engagement with the floor on which the chair or table rests, said securing means including an elongated nail terminating at one end in a sharpened point and at the other end in an enlarged head, said securing means further including a pair of elongated prongs on opposite sides of said nail terminating at one end in sharpened points, said enlarged head of said nail being mounted in a slot in said floor protector, each of said prongs having enlarged heads mounted in slots on opposite sides of the slot in said floor protector in which said head of said nail is mounted.

2. The assembly of claim 1 wherein said retainer has an upstanding peripheral wall surrounding said opening and is removably secured to said main body portion by mating threaded means on the outer periphery of said main body portion and on the inside of the peripheral wall of said retainer.

3. The assembly of claim 1 wherein said floor protector includes a rigid portion resting on the bottom wall of said retainer and an integral cushioning portion extending downwardly through said opening.

4. The assembly of claim 3 wherein said cushioning portion is of felt.

5. A floor protector assembly adapted to be secured to the leg of a chair or table for protecting the floor on which the chair or table rests from scuffing comprising:

a main body portion having securing means associated therewith for securing the same to the leg of a chair or table;

a removable floor protector retainer attached to said main body portion, said retainer having an upper wall and a bottom wall, an opening through said bottom wall; and a floor protector mounted in said opening and retained therein, said floor protector having a portion extending downwardly from and outwardly from the retainer beyond the bottom wall thereof for engagement with the floor on which the chair or table rests, said securing means including an elongated nail terminating at one end in a sharpened point and at the other end in an enlarged head, said securing means further including a pair of elongated prongs on opposite sides of said nail terminating at one end in sharpened points, said enlarged head of said nail being mounted in a recessed area in said floor protector, each of said prongs having enlarged heads mounted in recessed areas on opposite sides of the recessed area in said floor protector in which said head of said nail is mounted.

6. The assembly of claim 5 wherein said retainer has an upstanding peripheral wall surrounding said opening and is removably secured to said main body portion by mating threaded means on the outer periphery of said main body portion and on the inside of the peripheral wall of said retainer.

7. The assembly of claim 5 wherein said floor protector includes a rigid portion resting on the bottom wall of said retainer and an integral cushioning portion extending downwardly through said opening.

8. The assembly of claim 7 wherein said cushioning portion is of felt.

* * * * *